United States Patent [19]

Molitor

[11] 4,129,179

[45] Dec. 12, 1978

[54] APPARATUS FOR UTILIZATION OF WASTE ENERGY

[75] Inventor: Victor D. Molitor, Denver, Colo.

[73] Assignee: Stainless Equipment Company, Englewood, Colo.

[21] Appl. No.: 853,571

[22] Filed: Nov. 21, 1977

Related U.S. Application Data

[63] Continuation-in-part of Ser. No. 647,205, Jan. 7, 1976, abandoned, and a continuation-in-part of Ser. No. 789,938, Apr. 22, 1977, which is a continuation-in-part of Ser. No. 647,205.

[51] Int. Cl.[2] ..... F23J 11/00; F24C 15/20; F25B 29/00; F28F 27/02

[52] U.S. Cl. ..... 165/101; 55/222; 55/228; 55/256; 55/DIG. 36; 126/299 E; 165/27; 165/60; 165/DIG. 2; 237/52; 237/55; 261/151; 165/107 R

[58] Field of Search ..... 165/27, 59, 60, 106, 165/107, 101, DIG. 2; 55/222, 228, 255, 256, DIG. 36; 261/128, 150, 158, 159, 151; 126/299 D, 299 E, 299 F; 237/52, 55

[56] References Cited

U.S. PATENT DOCUMENTS

| | | | |
|---|---|---|---|
| 3,018,231 | 1/1962 | Valentine | 55/222 |
| 3,169,575 | 2/1965 | Engalitcheff | 165/60 |
| 3,276,514 | 10/1966 | Leonard, Jr. | 165/27 |
| 3,473,298 | 10/1969 | Berman | 55/222 |
| 3,661,366 | 5/1972 | Shinkle | 55/228 |
| 3,786,739 | 1/1974 | Wright | 55/DIG. 36 |
| 3,813,856 | 6/1974 | Jensen | 55/DIG. 36 |
| 3,841,062 | 10/1974 | Molitor et al. | 126/299 E |
| 3,854,388 | 12/1974 | King | 55/DIG. 36 |
| 3,892,825 | 7/1975 | Nazzer | 261/151 |
| 3,927,153 | 12/1975 | Tarhan | 261/151 |
| 3,967,940 | 7/1976 | Hirano et al. | 55/222 |
| 3,968,833 | 7/1976 | Strindehag et al. | 165/59 |

OTHER PUBLICATIONS

Aero Heat Exchanger, Niagra Blower Co., Bulletin #161, 9-12-73.

Performance of a Novel Sub-X Heat Exchanger, Huckaba and Master and Santoceri, Chem. Engring. Progress, vol 63, No. 7, 7-67.

*Primary Examiner*—Charles J. Myhre
*Assistant Examiner*—Sheldon Richter
*Attorney, Agent, or Firm*—Horace B. Van Valkenburgh; Frank C. Lowe

[57] ABSTRACT

A gaseous source of waste energy, including heat, is passed through a gas to liquid heat exchanger and then a chiller to agitate a water bath and produce evaporation of water for cooling. The heated transfer liquid is passed through a heat exchanger to heat makeup air or the like, while, alternatively, chilled water from the chiller is passed through the heat exchanger to cool the makeup air. The source of waste energy, including heat, is normally a grease extraction ventilator mounted to receive fumes and heated air from cooking equipment. Any other source of waste energy is normally suitable, such as heated air which has risen to the upper portion of a large room or enclosure, such as an auditorium, theater, meeting hall or the like. The heated air removed from such a position is adapted in part to be recirculated, but all of it may be used to furnish heat for heating fresh makeup air. Several forms of chiller, including specialized double compartment chillers, are disclosed.

17 Claims, 10 Drawing Figures

APPARATUS FOR UTILIZATION OF WASTE ENERGY

This application is a continuation-in-part of my copending application Ser. No. 647,205 filed Jan. 7, 1976, now abandoned, and a continuation-in-part of my copending application Ser. No. 789,938 filed Apr. 22, 1977, in turn a continuation-in-part of said Ser. No. 647,205.

This invention relates to apparatus for waste energy utilization, and more particularly to the heating of air by waste energy and the alternative chilling of water for cooling additional air.

With respect to the latter, numerous types of air treatment devices have been devised. In some types, generally known as the "swamp cooler" type, water is dripped into an air stream or contacted by the air by passing through a water absorbent pad. The air will cause a portion of the water to evaporate, thereby lowering the temperature of the air and the water, due to the number of b.t.u. required to equal the latent heat of evaporation of the water. For such cooling, the air normally should be relatively dry, since such a "swamp cooler" does not operate with real effectiveness when the relative humidity of the incoming air is excessive, such as over 50%. Thus, the so-called "swamp cooler" is particularly adapted for use at locations at which the relative humidity of the air is low but in the summertime when cooling is needed most. Obviously, cooled air having a relative humidity of 100% furnished to a room normally produces discomfort to humans in the room.

Among the objects of this invention are to provide waste energy utilization in which waste air may be passed into intimate contact with water accomplished with a relative minimum of complexity and expense; to provide such apparatus in which a flow of water may be proportioned to the volume of air such that not only is the air cooled, but the water is cooled and may be drawn off for heat exchange with additional air, this feature being particularly applicable to situations in which the initial air is objectionable for use as incoming air for the same or a different room. Such a situation may occur where the resulting air has an unacceptably high humidity or contains smoke or other products of cooking and the like, or is contaminated for any other reason.

Additional objects of this invention are to provide such apparatus in which separate liquids may be contacted by the same or different waste air flows, in order to chill a heat transfer fluid which may be utilized to chill other air, or any other desired cooling effect; to provide such apparatus which has dual chambers in each of which air contacts water, but in which the air may be provided by a common waste supply or by different waste supplies; to provide such a unit in which an initial supply of air may be divided for flow through a dual water bath and then recombined; and to provide such a unit in which different supplies of air may contact water in separate but back-to-back water units and then be discharged separately, with one discharge being used for cooling a room and the other supply being discharged to the atmosphere, such as due to an excessive humidity.

Further objects of this invention are to provide such apparatus associated with a source of heated waste air and gases, such as from cooking equipment, and in which the gases, after engagement with water contact means, such as passage against a water bath, as in a grease extraction ventilator of my U.S. Pat. No. 3,841,062 to strip the air of grease and other products of cooking, is passed through a heat exchanger to heat water or liquid passed therethrough. This heated water is used in a heating system when the outside temperature is lower than the temperature to be maintained inside, but alternatively, when the outside temperature is higher than the temperature to be maintained inside, this same air, after passage through the grease extraction ventilator, is passed through the heat exchanger for cooling, then against a water bath to evaporate a portion of the water and chill the water. The chilled water may then be supplied to one or more heat exchangers to cool air for passage into the room or other area to be cooled. These latter heat exchangers may be positioned at a remote location, even on a roof.

The manner in which the foregoing objects are attained, as well as other objects and the novel features of this invention, will become apparent from the description which follows, taken in conjunction with the accompanying drawings, in which.

Figure 3:
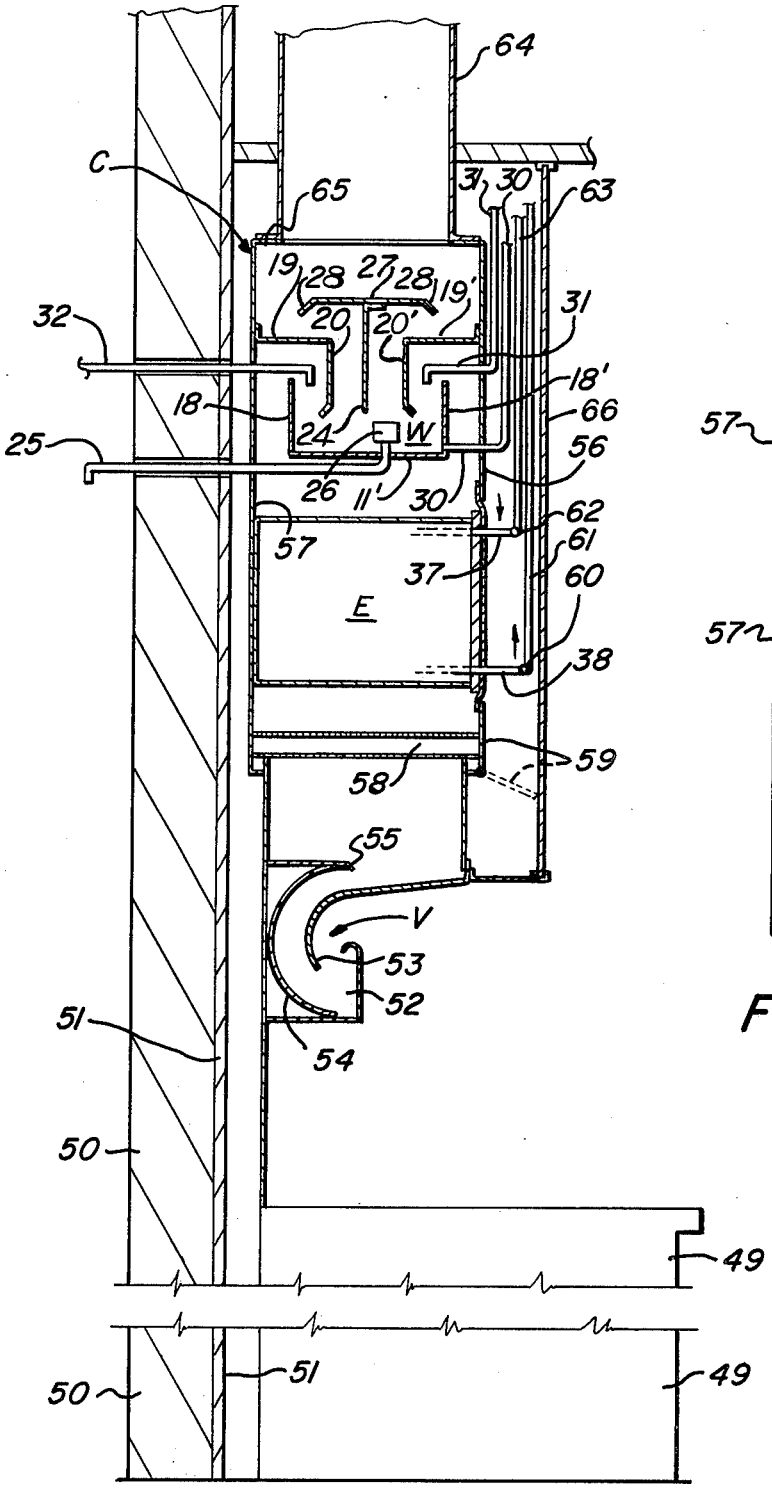

FIG. 3 is a diagrammatic, central vertical section of a grease extraction ventilator mounted over cooking equipment, with flow of the waste air, after grease extraction, through a heat exchanger for producing warmed water for heating use on cold days and, alternatively, passage of the waste air, after grease extraction, through a water chiller, to produce chilled water for air cooling on warm or hot days.

Figure 4:
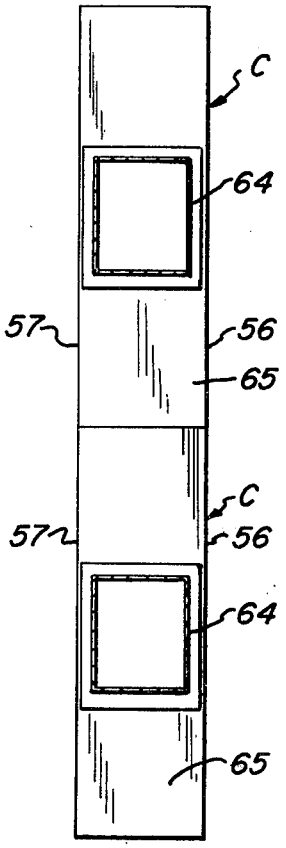

FIG. 4 is a top plan view, on a reduced scale, of the chiller of FIG. 3.

Figure 5:
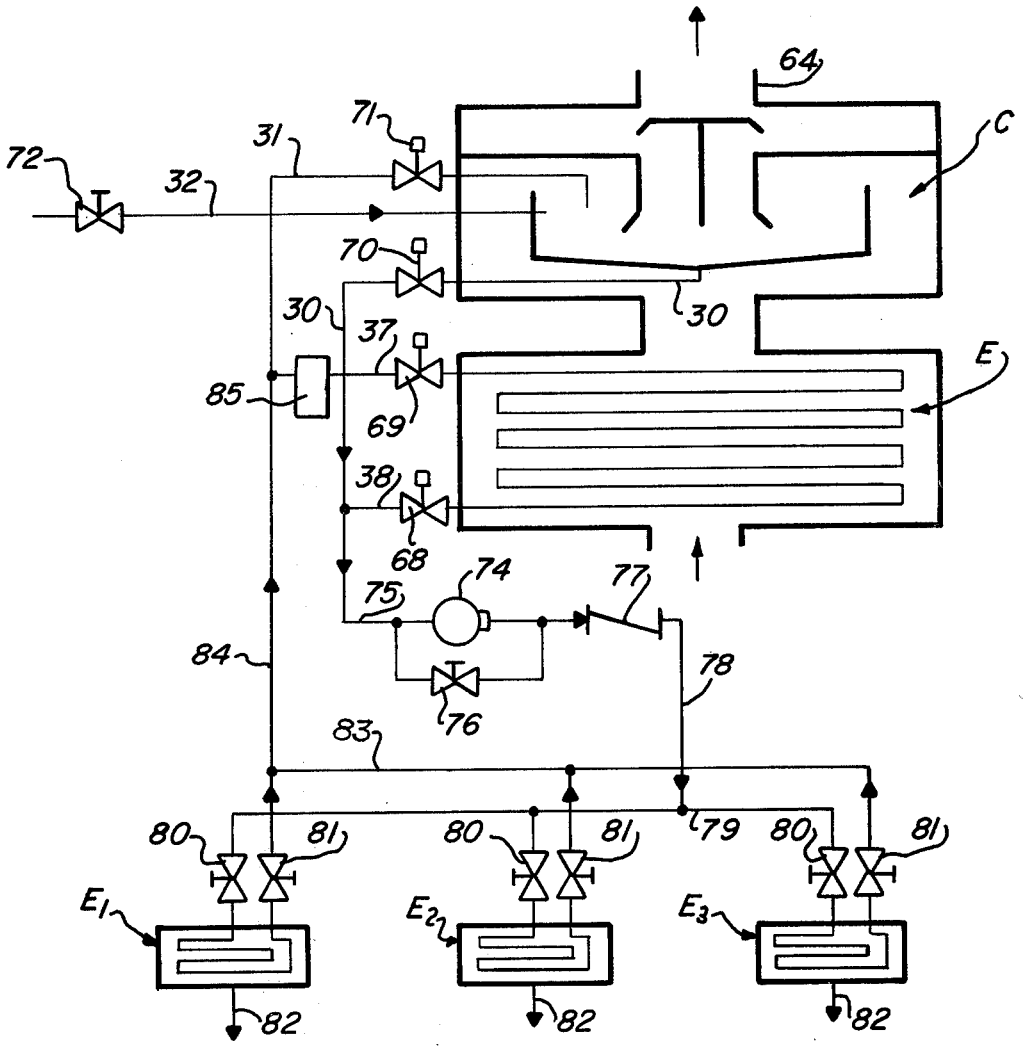

FIG. 5 is a schematic flow diagram showing the flow control devices utilized with the alternative heater and chiller of FIG. 3 and the makeup air heat transfer units.

Figures 6, 7:
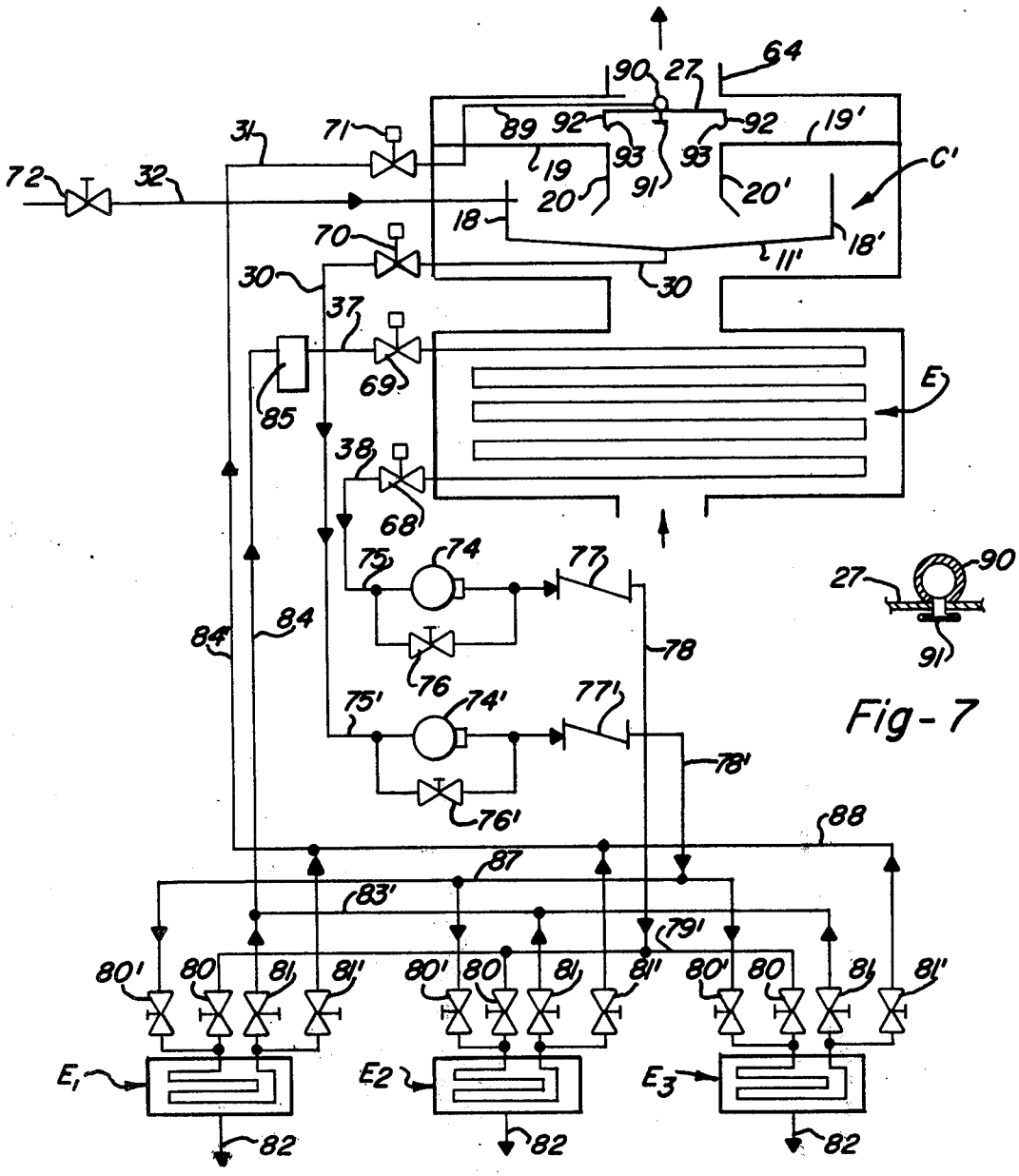

FIG. 6 is a similar schematic flow diagram showing an alternative arrangement in which individual makeup air heat exchange units may be supplied alternatively with a heating or cooling liquid and also showing an alternative return flow arrangement for the chiller.

FIG. 7 is a fragmentary section, illustrating a return flow baffle and nozzle arrangement shown diagrammatically in FIG. 6.

Figure 8:
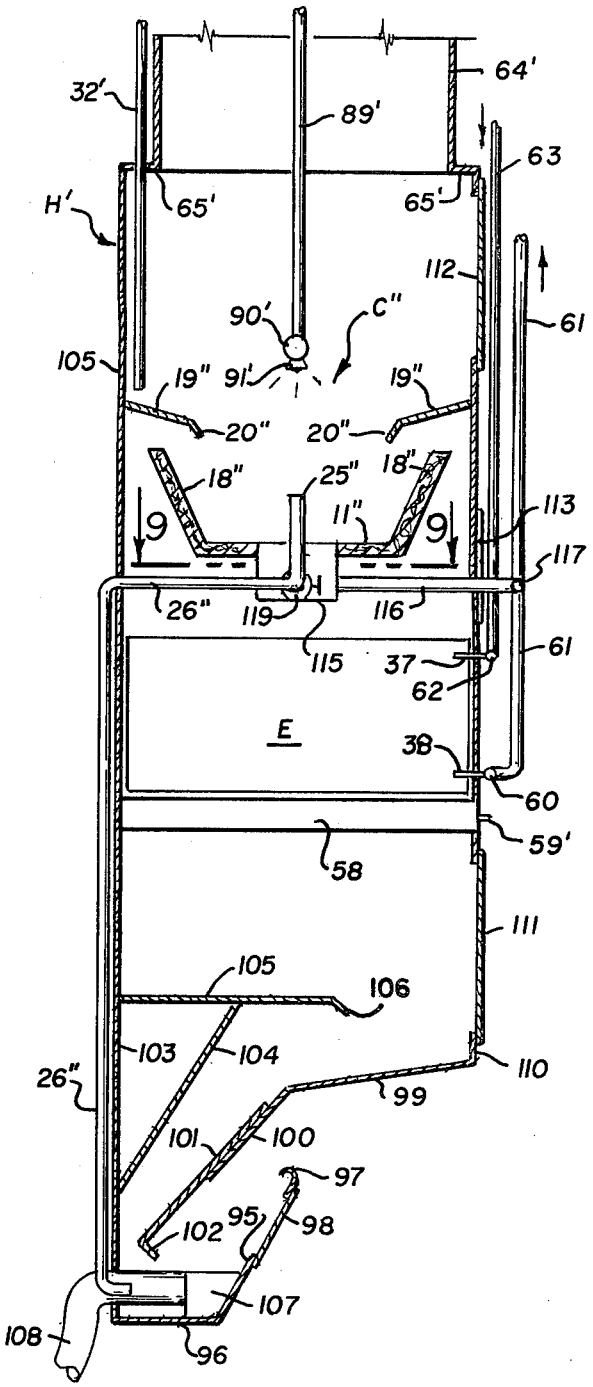

FIG. 8 is a diagrammatic, central vertical section of a grease extraction ventilator similar to FIG. 3, but having an alternative water chamber, baffle and overflow arrangement and showing particularly an alternative chiller construction.

Figure 9:
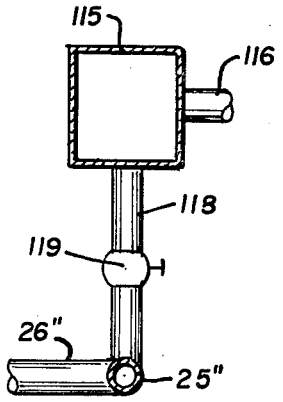

FIG. 9 is a fragmentary horizontal section, on an enlarged scale, taken along line 9—9 of FIG. 8.

Figure 10:
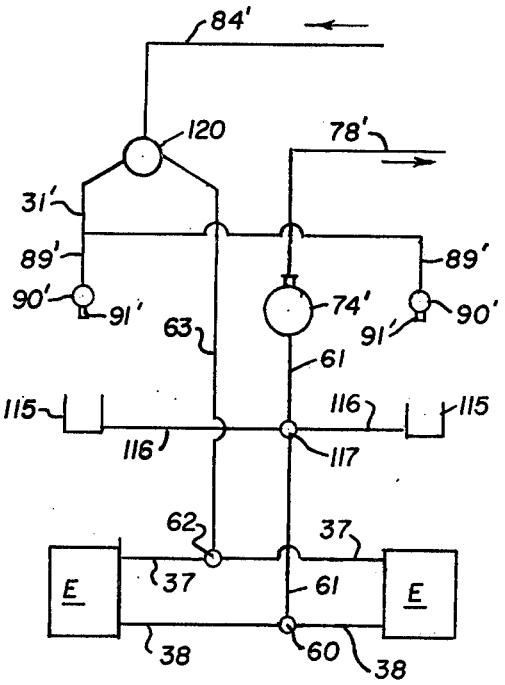

FIG. 10 is a schematic diagram of a pump and control valve arrangement for a pair of ventilators of FIG. 8.

Figure 1:
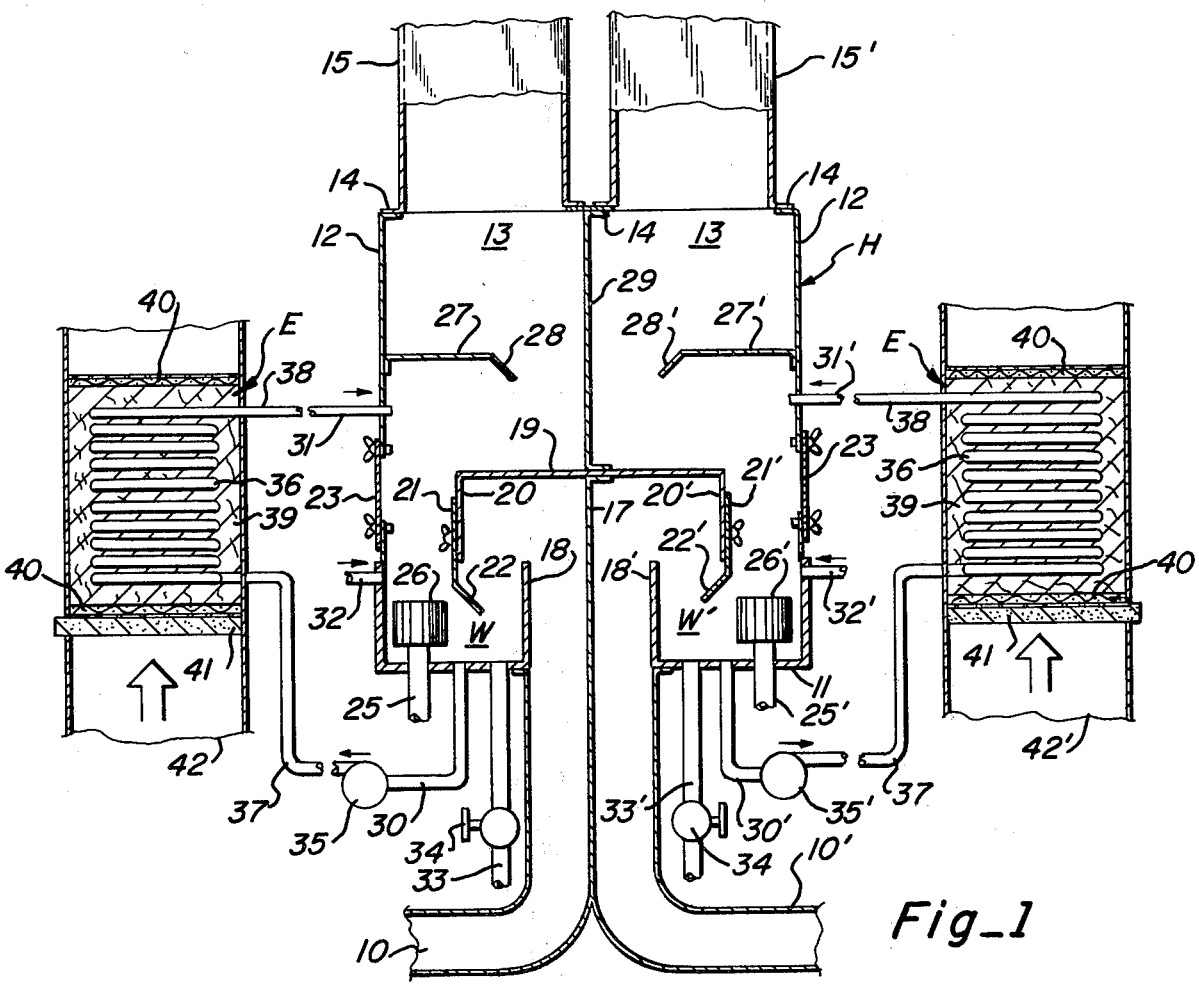
FIG. 1 is a diagrammatic, central vertical section of a waste air water chiller in which separate supplies of air are passed against individual water baths and used or exhausted separately, while the water chilled by the flow of air is, in each instance, passed through a separate heat exchanger for cooling air from another source.

In the waste air or gas water chiller of FIG. 1, a housing H encloses a pair of separate water bath chambers W and W′ which have individual liquid supplies and individual waste air or gas supplies through inlet ducts 10 and 10′, which are connected to a suitable aperture in a bottom plate 11 of the housing. The housing also includes side walls 12, end walls 13 and a top wall 14, the latter having apertures for attachment of a pair of exhaust ducts 15 and 15'. Extending between the end walls and centrally spaced to form a divider between ducts 10 and 10' is a vertical plate 17, while an upright wall 18 and 18' is spaced from each side of plate 17. Air or gases at each side flows over the upper edge of the respective wall 18, 18', while spaced above these walls is a horizontal plate 19 mounted atop divider 17 and extending between the end plates of the housing. At each edge, plate 19 has a depending flange 20 or 20' on which is adjustably mounted an angular baffle 21 or 21' which has a flange 22 or 22' extending downwardly toward the respective wall 18 or 18'. Plate 19, flange 20, 20' and flange 22, 22' force the air or gases to flow between wall 18, 18' and the lower edge of flange 22, 22'. The elevation of the lower edge of flange 22 and 22' is adjusted so that, with the particular volume of air or gases flowing, they will engage the upper surface of the water of the water bath and drive it upwardly and away from flange 22, 22' for impigement against the respective side wall 12 of the housing. A pair of removable plates 23 permit access to the respective baffle 21 or 21' for adjustment. An upright pipe 25 or 25' is respectively provided with a drain cap 26 or 26' at its upper end, in order to maintain the depth of water in the respective water bath at an appropriate level.

After passage upwardly from the water bath, the air or gases at each side encounters a transverse baffle 27 or 27' mounted on and extending inwardly from the respective side wall 12, each having a downwardly sloping flange 28 or 28' around which the air or gases pass. In doing so, the air or gases are subjected to a stripping action which removes water droplets, not only through the action of the flanges 28 or 28' per se, but also through the turning of the air or gases around the flanges, so that water droplets are thrown out due to centrifugal force. From the upper end of housing H, the cooled air or gases, i.e. cooled by evaporation of water, proceed upwardly on each side of a central partition 29 to an exhaust duct 15 or 15' for use as conditioned air in the same or another room, or merely discard. Flow through exhaust duct 15 or 15' may be occasioned by a conventional type of suction fan (not shown) in the duct beyond the extent shown in the drawing.

In addition to the use of the resulting air as an air conditioning agent, or the cooling of additional liquid by passage of the cooled air through a heat exchanger, additional liquid, i.e. from the water bath, is available for additional cooling of a gas, such as air. Thus, cooled water from the respective water baths W and W' may be withdrawn through a pipe 30 or 30' and returned through a pipe 31 or 31', respectively. Cooled fluid thus withdrawn may be utilized in a heat exchanger E, described below, for cooling additional air. If necessary, makeup water may be supplied through a pipe 32 or 32', while either water bath may be drained by a drain pipe 33 or 33' connected at the bottom of the respective water baths, with flow therethrough being controlled by a valve 34. In normal operation, the drain valve 34 is closed.

In the event that air flowing through either exhaust duct 15 is to be discarded because it is not usable, such as through an excessive humidity, it may be desirable to utilize the cooled air to cool water or other heat exchange liquid. Since the waste air or gases received through inlet ducts 10 and 10' is normally from different sources and, after passage through the chiller, may be disposed of in different ways, it is also normal that the water cooled by the respective water baths W and W' will be cooled to different temperatures. Thus, effectiveness in cooling will be enhanced by passing makeup air first through the warmer heat exchanger E and then through the cooler one. In addition, air which has passed through water bath W and air which has passed through water bath W' may have compatible properties, such that a mixture of such air, even though at slightly different temperatures and at slightly different relative humidities, would, nevertheless, be capable or producing a desired cooling effect, when introduced into a particular room, without producing discomfort to persons in that room.

The advantage of the dual water bath for dual air streams which may be utilized as inflowing air for cooling the same or a different room or exhausted to the atmosphere, is pronounced, when the air supply to one duct, such as duct 10, is taken from the area above a dishwasher, for instance, which will tend to produce heated air with a high humidity. The air supplied through the duct 10' may also be taken from an area near the dishwasher, such as below the dishwasher, in which event the air may be cooler and have a lesser humidity. By passing the high humidity air through one water bath and the other supply of air through the other water bath, considerable flexibility in the arrangement may be obtained. Cold water outlet 30 or 30' is connected to a pump 35 or 35', respectively.

Each heat exchanger E is conveniently of the type described in my copending application Ser. No. 621,284, filed Oct. 10, 1975, now U.S. Pat. No. 4,071,935, i.e. having a series of coils 36 through which the liquid to be cooled is passed from an inlet 37 to an outlet 38, with each inlet 37 being connected to pump 35 or 35'. The coils 36 are initially formed in an axially spaced position, then a stack 39 of loosely woven cloth of copper, aluminum, or other material, is placed between adjacent coils to occupy also the central space within and outer spaces without a coil turn. The coil assembly is then compressed until the cloth 39 has been deformed to provide contact with the surfaces of the coils and thus have a greater propensity for the flow of heat between the fibers or threads of the cloth and the coils. The compressed cloth is maintained under pressure by the coils 36 and also by a screen 40 at each end. A conventional filter 41 may be placed across the entrance of the heat exchanger E, in order to prevent any particulate material from lodging within the compressed cloth of the heat exchanger.

The respective heat exchangers E are mounted in ducts 42 and 42'. If desired, and probably utilized more often, the chilled water outlet pipes 30 and 30' may be connected to upper ends of the respective coil 36, with the lower end of the coil connected to return pipe 31 and 31', respectively, to provide countercurrent flow in each of the respective heat exchangers. In addition, the cooled water flowing through pipe 30 may be led to the incoming water pipe 31' for the water bath W', the water bath W thus being utilized as a pre-cooler for the water bath W'. The then chilled water from water bath W' may be circulated from pipe 30' through a heat exchanger to chill additional air or the same air which has been initially chilled by heat exchange in the duct. The water exhausted from this heat exchanger may be introduced into the water bath W through pipe 31. In this way, the maximum cooling effect from the energy available may be obtained.

It will be understood, of course, that the air supplied through duct 10 to water bath W may have sufficient humidity that, after engagement with the water bath, the humidity will be so high that the air should not be used for direct introduction into a room. However, this does not mean that, when initially introduced through duct 10 or 10', for instance, the air is not able to pick up sufficient moisture to produce a cooling effect, but normally to the contrary, since heated air having the same number of grains of moisture per pound of dry air, has a lower humidity than air at a lower temperature. Thus, the heated air, such as taken from above a dishwasher, for instance, although containing a considerable amount of moisture, will still be able to pick up additional moisture, even to the point of saturation, and lower the temperature of the water bath against which it is directed.

Figure 2:
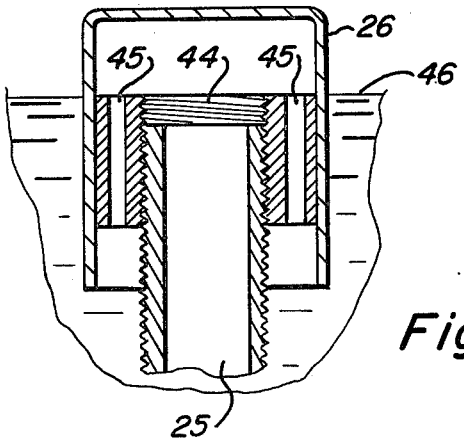
FIG. 2 is a vertical section, on an enlarged scale, of a drain pipe and an overflow cap utilized in the water baths of FIG. 1.

One possible construction of the drain cap for the overflow pipe 25, as illustrated in FIG. 2, includes an inwardly extending boss 44, threaded on the inside so as to be adjustable upwardly and downwardly on pipe 25 and provided with an annular series of vertical holes 45 through which water flow for discharge, in the event the water level 46 exceeds the top of boss 44. Ordinarily, the water level will be sloping, due to the impingement of air on the water, so that the drainage level will be a composite of the various levels around the cap. Normally, the water level 46 is maintained level with the upper edge of boss 44, as shown, so that no outflow will occur until the water level becomes higher. Although the surge and flow of the water, under the influence of the air stream, will cause the level 46 to fluctuate slightly, a generally average level will be maintained, since the water contour in front of pipe 25 may be lower than the level 46 and the water contour rearwardly of pipe 25, i.e. toward the corresponding side wall 12', may extend upwardly and above the level 46.

The apparatus of FIG. 3 is adapted to take advantage of the heat contained in air and gases which are removed from above cooking equipment 49, such as a grill or stove, and which is then passed through a grease extraction ventilator having water contact means, as of the type of U.S. Pat. No. 3,841,062, in which the air is passed against a water bath with a sufficient velocity to cause turbulence of the water, and stripping of the grease, smoke and other products of cooking equipment, except perhaps carbon monoxide and toxic gases. The cooking equipment and grease extraction ventilator V are mounted in front of a wall 50 having an insulating layer 51 to reduce the fire hazard. In flowing through ventilator V, the air is forced to engage water in a space 52 by movement around the forward, lower edge of baffle 53, so as to force the water against a curved rear plate 54, then pass around a baffle flange 55, for a purpose similar to that of flange 28 on baffle 27 of FIG. 1. After passage through the grease extraction ventilator V, waste air is passed through a rough filter 58, such as formed of fiberglass, access to which is obtained through a door 59, which may be tipped downwardly to the dotted position, for that purpose. This air still retains heat from that produced by the cooking equipment and is passed through a heat exchanger E, such as similar to that previously described, with pipe coils and compression against cloth of copper or other suitable material, or any other appropriate construction. This heat exchanger is provided with an inlet pipe 37 and an outlet pipe 38 for a heat transfer fluid, such as water. By flowing through the heat exchanger, the still heated air heats the fluid supplied by inlet 37 and flowing from the outlet pipe 38 for countercurrent flow. The heated water or other fluid, from outlet pipe 38, is supplied to an air heater which may be similar to heat exchanger E but in which air for air conditioning purposes is heated by flow therethrough and then transmitted to the room or area to be heated. It will be understood, of course, that the air and gases rising from the cooking equipment 49 would pass through ventilator V and may be contaminated by cooking ordors or the like, which may prevent it from being used as air ultimately supplied to a room or enclosure.

When cooling is called for, the waste air and gases may still flow through the heat exchanger E for cooling the air prior to flow through a chiller C, to which water is supplied for evaporation and resultant cooling. The heat exchanger E and chiller C are installed within a passage having a front wall 56 and a rear wall 57, with appropriate end walls. The width of the front and rear walls depends upon the width of the cooking equipment and the corresponding number of heat exchangers E and chillers C. With two chillers C, as in FIG. 4, above two grease extraction ventilators V, and on the order of four to six heat exchangers E beneath each chiller C, the outlet 38 of each heat exchanger may be connected to a manifold 60 which connects with a warm water supply pipe 61. Similarly, return pipes 37 are connected to a header 62 which connects with a return pipe 63, the pipes 37 and 38, for instance, being connected to manifolds for operation of several heat exchangers in parallel.

The chiller C of FIG. 3 is similar in function to the chiller of FIG. 1, except for a single inlet and outlet for the same waste air and same discharge air and common water bath. The waste air flows to each side of a bottom wall 11', being forced by baffles 19 and 19' to flow over upright walls 18 and 18' and into the water bath W. Transverse plates 19 and 19' are provided with depending baffles 20, 20', each of which extends toward the corresponding wall 18 or 18' at the lower edge. Thus, the water is driven from each side against a central partition 24, with the air then passing upwardly on opposite sides of partition 24 to the underside of a transverse baffle 27 and around the downwardly extending flanges 28 at each side thereof. The air then passes through a discharge duct 64, which is connected with top 65 of the chiller, as also shown in FIG. 4. The chilled water flows through pipe 30 from adjacent the bottom 17 of the water bath or reservoir to a remote heat exchanger, being returned through the return inlet pipe 31. As before, water makeup pipe 32 extends to a position above the water bath W, while an overflow pipe 25 extends to a position centrally of the water bath and within a cap 26, to maintain the desired level therein. The front of the apparatus is closed by a removable panel 66.

The apparatus of FIG. 3 is further adapted to carry out a method of this invention in which the gases exhausted from a cooking or similar area are used not only to save heat energy, but also to save fan or blower energy. Thus, the passage of such exhaust gases through a grease extraction ventilator V, a gas to liquid heat exchanger and a water evaporative chiller C not only cleans the exhaust gases but extracts heat therefrom for heating purposes, with a consequent saving of heat energy, as well as cooling the exhaust gases to minimize heat pollution effects. In the chiller, the exhaust gas is cooled at the same time that the water is chilled by evaporation, so that, again, the exhaust gases are cooled to reduce the heat pollution effect thereof, while refrigeration of room makeup air is obtained at very little additional operating cost. As indicated previously, during cooling the waste air from the grease extraction ventilator V is passed through the heat exchanger E for precooling prior to passage through the chiller C. The heat so recovered may be used to preheat water for a hot water heater, while the heated water from heat exchanger E may be circulated through grease extraction ventilator V for precooling the exhaust air prior to passage through chiller C, to increase the total cooling effect, particularly when the wet bulb temperature of the air is not reached in the chiller C.

In FIG. 5 are shown three heat exchangers $E_1$, $E_2$ and $E_3$, each of which is adapted to receive alternatively either heating water from the heat exchanger E or cooling water from the chiller C of FIG. 3. For controlling the flow of heated water to the heat exchangers $E_1$, $E_2$ and $E_3$, a valve 68 is placed in the heated water supply pipe 38 and a valve 69 in the heated water return pipe 37. Similarly, a valve 70 is placed in the chilled water outlet pipe 30 and a valve 71 in the chilled water return pipe 31, with a metering valve 72 in makeup supply line 32.

A pump 74 is supplied by an inlet pipe 75 to which heated water pipe 38 and chilled water pipe 30 are each connected. A bypass pump flow valve 76 permits the water pressure produced by the pump to be adjusted, while a check valve 77 prevents backup. A pump discharge pipe 78 feeds into a header 79 for supplying the respective heat exchangers $E_1$, $E_2$ and $E_3$ with heated water or alternatively, chilled water. The inlet and outlet flows of each heat exchanger are controlled by valves 80 and 81, respectively. The heat exchangers each contain a coil 36, with air being passed through the heat exchangers, in the direction of arrow 82. The heat exchangers $E_1$, $E_2$ and $E_3$ may normally be placed at different or remote locations, as in such a position that the air discharged from each may pass directly or nearly directly into the room or other area to be heated or cooled. Any of the heat exchangers $E_1$, $E_2$ or $E_3$ thus may be placed in a separate space designed for it, in a wall, above a false ceiling, or even on a roof. Particularly when installed on a roof top, or in any other position where a heat exchanger $E_1$, $E_2$ or $E_3$ may be exposed to freezing temperatures, the coils of the heat exchanger should be provided with a drain valve responsive to a thermostat located just outside the heat exchanger. This thermostat is set to cause the drain valve to open, as when a temperature of 0° C., for instance, is reached. The return flow from the heat exchangers is to a header 83, then through a pipe 84 and thence through the respective return pipes 37 and 31, except that a surge tank 85 is placed in the return line 37 to heat exchanger E, to accommodate a surge of water when heat is changed to or initiated. The water bath in chiller C acts as a surge tank in similar circumstances. Suitable blowers, conventional in nature, for moving the air through the heat exchanger E and the chiller C may be placed in the exhaust duct 64, while blowers for moving air through heat exchangers $E_1$, $E_2$ and $E_3$ are conveniently placed at the intake, so as to push air through the heat exchangers.

It will be noted that the heat exchanger E, when in use, not only provides heated water or fluid to heat cold makeup air, but also cools the exhaust gases from the cooking equipment, thereby reducing or perhaps eliminating the heat pollution effect of the kitchen exhaust system. The chiller C also has the dual function of not only providing chilled water for cooling hot makeup air, but also cooling the exhaust kitchen air, thereby again reducing the heat pollution effects thereof. In conjunction with the apparatus of FIG. 5, there should be an integrated air transfer system which includes a number of strategically located fans to move the air in a building, for instance, from one area to another of the purpose of pressure balancing the entire building.

The heating and cooling control valves, i.e. valves 68, 69 and 70, 71, may be solenoid valves, as indicated, so as to be controllable by a thermostat responsive to the need for heating, or cooling, as the case may be. Thus, valves 68 and 69 will be opened, as well as pump 74 started, when there is a need for heating recognized by the thermostat. When the need for heating no longer exists, the pump 74 is stopped and the valves 68, 69 closed. Similarly, when there is a need for cooling, valves 70 and 71 are automatically opened and pump 74 started, with closing and stopping, respectively, when there is no longer a need for cooling. It will be noted that a special heat transfer fluid may be pumped through heat exchanger E, but in view of the probability, at the start and stop of the respective cycles, of its becoming mixed with water from the chiller C, water is preferred as the heat exchange liquid for heat exchanger E. In the event of very high or very low outside temperatures, the heating or cooling may be supplemented by heaters or refrigeration coolers.

The diagram of FIG. 6 is similar to the diagram of FIG. 5, with corresponding parts having the same reference numerals. One difference is in furnishing either heating or cooling alternatively, to any of the heat exchangers $E_1$, $E_2$ or $E_3$, individually, rather than as a group. Thus, heated water pipe 38 connects with inlet pipe 75 for pump 74, without any cooled water being supplied, so that pump 74 supplies, through pump outlet pipe 78, a distributing pipe 79' for heated water alone, from which heated water may be supplied to any one or more heat exchangers $E_1$, $E_2$ or $E_3$ by opening the respective inlet valve 80 thereof. Pump 74 may be running at the time, or then started, if the inlet valve 80 is the first to be opened. At the same time, the corresponding outlet valve 81 is opened for return of the previously heated water, after circulation through the corresponding heat exchanger, to a header 83', from which the return flow is led by pipe 84 through surge tank 85 and then through inlet pipe 37, back to the coil of the heat exchanger E. The cooled water pipe 30, leading from chiller C', extends to an inlet pipe 75' for pump 74'. Bypass valves 76 and 76' and check valves 77 and 77' perform the same function for pumps 74 and 74', respectively, as bypass valve 76 and check valve 77 of FIG. 5. Pump 74' supplies cooling water to a pump outlet pipe 78', in turn connected to a cooled water distributing pipe 83, from which cooling water may be supplied to one or more selected heat exchangers $E_1$, $E_2$ or $E_3$ by opening the inlet valve 80' therefor, with pump 74' being started as the first valve 80' is opened or continuing to run if another valve 80' is open. The corresponding outlet valve 81' is opened to return the water, after circulation through the coil of the corresponding heat exchanger, to a header 88 connected to a return pipe 84' which, as before, connects with chiller return pipe 31. The valves 68 to 72 function as described previously.

In FIG. 6, an alternative manner of returning to the chiller C' the water previously circulated to one or more of the heat exchangers $E_1$, $E_2$ or $E_3$, including changes in the baffle construction of the chiller, is also illustrated. Thus, the chiller includes a bottom plate 11', spaced upright walls 18 and 18' over which the air is forced to flow, by baffles 19 and 19', into engagement with a water bath between walls 18 and 18' on bottom 11, similarly to the chiller C of FIG. 3. Also, the air flows under the lower lips of depending flanges 20 and 20', as before, but the center baffle 24 of FIG. 3 is omitted. Thus, after churning the water bath and producing evaporation for cooling, the air passes to each side, beneath transverse baffle 27 and over each corner between a baffle 19 or 19' and the corresponding flange 20 or 20'. In addition, instead of being returned into the water bath by pipe 31, as in the case of chiller C of FIG. 3, the return flow from the heat exchangers $E_1$, $E_2$ or $E_3$ passes from pipe 31 into a pipe 89 which connects with a longitudinal manifold 90 extending centrally atop baffle 27. A spaced series of nozzles 91, having a 90° turn and adapted to produce a horizontal, fan-shaped spray longitudinally of and beneath baffle 27, are connected to manifold 90 through baffle 27, as in FIG. 7. The laterally spreading sprays from nozzles 91 impinge against depending flanges 92, at each edge of baffle 27, and the water so impinging against the flanges drips or falls downwardly from the lower edges of a lower inwardly slanting lip 93 of each flange 92. The water so dripping or falling forms, in effect, a thin curtain of water through which the air or gas passes for evaporation of some of the water and further cooling of the remaining water. A series of nozzle 91 are preferably mounted to direct sprays from the area of outlet duct 64, in opposite directions toward the end of the chiller, to avoid the production of a water curtain effect at the position of the duct and reduce the amount of water which might be entrained in the air and discharged into the atmosphere.

Such additional evaporation of water from the curtains is of advantage when the wet bulb temperature of the air is not reached through agitation of the water bath and maximum cooling is desired. A portion of the water discharged by nozzles 91, such as directed centrally under the baffle 27, will, of course, fall toward the water bath within impinging against a flange 92, but the air passes upwardly from the water bath and will have an opportunity to engage this falling water to produce additional evaporation and cooling. In fact, spray nozzles 91 may produce sufficiently divergent sprays, directed in the area between depending flanges 20 and 20' and covering enough of the area that a sufficiently large portion of the air or gases will encounter water so sprayed that transverse baffle 27, above the water bath, may be omitted.

In use, the air passed through heat exchangers $E_1$, $E_2$ or $E_3$ may be only a portion of the air circulated to the area to which supplied, such as a room, since a portion of the air to the room may be untempered outside air. Normally, at least a portion of the incoming air should be outside air to maintain an adequate oxygen supply. There will be times when the outside temperature is such that the makeup air for one or more areas will need to be neither heated nor cooled. However, when heating is called for during severe weather conditions, such as approaching or below freezing, and the heat produced by the grease extraction ventilators is insufficient, supplemental heating may be utilized, such as bypassing a portion of the makeup air through a conventional air heating furnace, either outside makeup air or makeup air which has already passed through a heat exchanger $E_1$, $E_2$ or $E_3$. Or, a supplemental heater may add additional heat to the room or area by circulating air from the area through the supplemental heater and back to the area. The need for supplemental heating is occasioned when the outside air temperature during severe weather is below a temperature determined by the heat available for the heat exchange liquid at the heat exchange means involved. Similarly, supplemental cooling by mechanical refrigeration may be used during hot months at times when the outside temperature is sufficiently high that the cooling effect of the cooled water produced by the chiller C or C' does not produce sufficient cooling of the makeup air. That is, the need for supplemental cooling is occasioned by the outside air temperature being above a temperature determined by the cooling available from the chilled water at the heat exchange means involved. Thus, either outside makeup air or makeup air which has already passed through a heat exchanger $E_1$, $E_2$ or $E_3$ may be cooled by a conventional mechanical refrigeration system. Or, supplemental refrigeration equipment may further cool the chilled water from the chiller, or may cool air circulated from the room. Such supplemental heating equipment may need to have only 40% of the capacity of that necessary for heating the areas without the waste heat recovery system of this invention, while the supplemental cooling equipment may need to have only 50% of the capacity of that necessary for cooling the areas without the cooling phase of the waste energy recovery system of this invention. It will be understood that each of the heat exchangers $E_1$, $E_2$ and $E_3$ may represent a plurality of individual heat exchangers, in a bank or row, and that more than three separately controlled areas may be supplied with heated or cooled makeup air.

The apparatus of FIG. 8 includes a modified grease extraction ventilator, or a pair of ventilators, adapted to be installed above and receive heated air and gases from the cooking equipment, similar to FIG. 3. Such a ventilator is provided with a water contact means having an outwardly inclined front wall 95 which extends upwardly from a bottom 96 and which has a curl 97 at its upper edge. A lateral series of panels 98 may be removably attached to the outside of wall 95, opposite apertures provided for the purpose, for inspection and cleaning purposes. Gases rising from the cooling equipment pass upwardly around wall 95 and also against a rearwardly and downwardly inclined bottom wall 99 of a space above the water contact means, with suction pulling the gases through a throat between curl 97 and a flange 100 extending downwardly from wall 99 at a greater angle to the horizontal and diverging from wall 95. The suction is produced by an exhaust fan at the end of a duct 64' connected to the top of housing H'. A plate 101 is adjustable along flange 100 and has an essentially perpendicular lip 102 at its lower edge, the position of which is adjusted toward and away from a water bath contained in a chamber between front wall 95, bottom 96, a rear wall 103 of both the chamber and the housing and appropriate end walls. In passing around the lower edge of lip 102, gases are desirably forced into engagement with the water bath for removal of grease, smoke particles and the like, with the position of lip 102 normally dependent on the volume of gas flow, both below the lip and also between the lip and rear wall 103. The gases also pass through a diverging throat section between plate 101 and a forwardly inclined, angular baffle 104 which extends upwardly to intercept a horizontal baffle 105 having at its front edge a downwardly extending, moisture stripping lip 106. The baffle construction of the water contact means of FIG. 8 appears to increase the washing action over lower ranges of flow and further appears to be quieter in operation than the water contact means of FIG. 3. Also, the angular construction of FIG. 8 is less expensive to manufacture than the curved baffle and plate construction of FIG. 3. The water contact means of FIG. 8 is provided with an open top, overflow box 107, which maintains the average level of water in the bath within a desired range, while a drain pipe 108 connects with box 107 and leads to a suitable point of disposal. The water chamber may be provided with a sump pump having a screened intake adjacent bottom 96 at one end, as in my copending application Ser. No. 768,152 filed Feb. 14, 1977, and delivering the water from the chamber to a filter for removal of grease and other particles, then return to the water chamber.

Upon discharge from the throat between lip 106 and wall 99, the gases expand in the space above, bounded at the rear by wall 103, at the front by front wall 110, and at the ends by appropriate end walls of housing H', to drop additional moisture. Front wall 110 may be provided with a laterally spaced series of removable access panels 111 adjacent its lower end, a similar series of access panels 112 adjacent its upper end and one or more intermediate access panels 113. The gases then pass through a strainer 58, having a handle 59' for removal for inspection and cleaning, and into a heat exchanger E of the construction described previously. One or more heat exchangers E may be mounted in the same ventilator, with an outlet 38 of each connected to a manifold 60, from which a pipe 61 leads, and an inlet 37 of each connected to a manifold 62, supplied by a pipe 63. A heat exchange liquid, usually water and which, when heated, is supplied to a heat exchange means, such as corresponding to a heat exchanger $E_1$, $E_2$ or $E_3$ of FIG. 5, is conveyed through pipes 61 and 63 in the direction of the respective arrows.

After passage through heat exchanger E, the gases are drawn into a chiller C'' having a water bath in the space above a bottom 11'' and outwardly inclined side walls 18'', the bottom and side walls being double walled, with insulation between, to reduce conduction of heat from the gases passing along the bottom and around the side walls. The gases passing around the upper edge of each side wall 18'' of the water chamber are deflected downwardly by an inclined baffle 19'' at each side, each provided with a depending lip 20'' which, in turn, is inclined downward at a greater angle, but toward the center, rather than toward the side walls. These baffles and lips direct the air into engagement with the water contained in the water chamber, the level of which is maintained by the overflow pipe 25'' connected to a drain pipe 26'' which feeds into the ventilator water chamber adjacent drain pipe 108. The drain pipe 26'' is also used for an additional purpose, as will be described later, while makeup water, for the chiller, may be introduced through a pipe 32'. The gases which engage the water bath agitate the bath and produce evaporation, as well as carry droplets of water along with them which tend to evaporate. As the gases expand into the area above baffles 19'', the remaining droplets of water will tend to settle out and fall downwardly onto the baffles to drip down from the lower edge of flanges 20'', for engagement there by the gases. When the chiller is in use for cooling purposes, the returning water is delivered by a pipe 89' to a horizontal manifold 90', to the underside of which a plurality of nozzles 91' are attached, from which the water is sprayed downwardly into the opening between the flanges 20'', for further engagement by the gases passing upwardly between the flanges. This produces additional evaporation and cooling of the water sprays, which then drop into the water bath to decrease the temperature thereof.

The cooled water of the chiller collects in a box 115 which is inset into the bottom 11'' and depends therefrom for connection to a pipe 116, which leads to a manifold 117 connected in pipe 61 for a twofold purpose. First, when the chiller is in use and cooled water is being distributed to the heat exchange means, such as corresponding to the heat exchangers $E_1$, $E_2$ and/or $E_3$ of FIG. 5, the cooled water is supplied from the chiller C'' through the same piping which connects the heat exchangers E, thus simplifying the piping arrangement. In addition, when the chiller is not in use and no water is being returned through the pipe 89', but water is being pumped from the heat exchangers E to a point of use through pipe 61 and then returned through pipe 63, very little water will circulate from the chiller, since the water returned through pipe 63 will force the water to be heated through the heat exchanger E and into the pipe 61. However, the connection to box 115 of the chiller prevents air from collecting in pipe 61 when a change over from the heat exchangers E to the chiller C'', or vice versa, is effected, thus acting in a manner similar to the surge tank 85 of FIG. 6.

As in FIGS. 8 and 9, the pipe 116 from the box 115 extends forwardly, while the drain pipe 26'' from the overflow pipe 25'' extends rearwardly. An additional drain pipe 118 connects a point adjacent the bottom of the box 115 with the drain pipe 26'', with a manually operated valve 119 interposed, to permit drainage of the chiller C'', when there is any possibility of the water in the chiller being frozen while not in use, as during extreme weather conditions and the chiller C'' being exposed to such conditions. Access to valve 119 is obtained through removal of an appropriately positioned panel 113. When the water chamber of the ventilator is to be drained for the above purpose, the sump pump previously mentioned may be utilized, with the pump outlet connected to a drain.

A suitable arrangement for controlling optional heating, as of makeup air, from heat exchangers E in each of two ventilators, or cooling makeup air by water chilled in the chillers C'', is illustrated in FIG. 10. This arrangement includes connection of pipe 61 to a pump 74' corresponding in function to pump 74 of FIG. 5, but supplying heated water from heat exchangers E, such as a bank of heat exchangers E in each of two ventilators, when heat exchange fluid, such as water, is being returned to the heat exchangers E through pipe 63. Pump 74' pulls chilled water from the boxes 115, pipes 116 and manifold 117, when the return flow through pipe 63 is shut off. In each instance, the heat exchange fluid, normally water, is supplied through a pipe 78' to heat exchange means positioned at the point of use, such as for heating or cooling makeup air. A return pipe 84' from the remote heat exchange means leads to a three-way valve 120 having an inlet connected to pipe 84' and alternate outlets respectively connected to pipe 63 and a pipe 31'. Valve 120 may be solenoid operated, so as to be controlled by a pushbutton arrangement located at a convenient position, as at the ventilator controls. When one outlet of three-way valve 120 is connected to pipe 63, the return flow from pipe 84′ will pass to the heat exchangers E. However, when the other outlet of three-way valve 120 is connected to pipe 31′, the return flow will, instead, pass through pipes 89′, manifolds 90′ and nozzles 91′. As will be evident, simple changes may be effected to produce a suitable arrangement, similar to that of FIG. 10, for controlling a single ventilator having a plurality of heat exchangers E but a single chiller C′.

Although the utilization of waste energy from cooking equipment through air passed through a grease extraction ventilator has been illustrated and described and the utilization of waste energy from air taken above and below a dishwasher has been referred to, it will be evident that various other sources may be utilized. For instance, heat contained in heated air removed from the upper portion of a large room or enclosure, such as a theater, auditorium, meeting hall or the like, may be used to heat or preheat incoming makeup air, when the outside temperature is less than that to be maintained in the enclosure. When the outside temperature is greater than that to be maintained in the enclosure, air from the upper portion of the enclosure may be passed through a chiller to provide water for chilling makeup air in a separate heat exchanger.

Although different embodiments of this invention have been illustrated and described and certain variations thereof also described, it will be understood that other embodiments may exist and that various changes may be made, without departing from the spirit and scope of this invention.

What is claimed is:

1. In apparatus for recovering waste energy, the combination of:
- a gaseous source of waste energy, including heat;
- a gas to liquid heat exchanger;
- means for moving a heat transfer liquid through said heat exchanger to heat said liquid;
- means for causing the gas from said gaseous source of waste energy to pass through said heat exchanger to heat said heat transfer liquid;
- heat exchange means, including a path for a heated or chilled liquid to heat or cool, alternatively, makeup air for a room and the like;
- means for passing makeup air through said heat exchange means;
- means for circulating said heated heat transfer liquid through said heat exchange means;
- a chiller having walls and baffle means for directing air toward a water bath for agitating the bath and producing evaporation of water for cooling said water and said air;
- means for supplying water to said chiller to form a water bath;
- means for flowing said waste energy gas through said chiller from said heat exchanger for agitating said water bath to chill said water; and
- means for alternatively circulating said chilled water from said chiller through said heat exchange means.

2. In apparatus as defined in claim 1, wherein:
- said means for circulating said heat transfer liquid and chilled water through said heat exchange means includes a common pump and inlet and outlet valves for each of said chiller and said heat exchanger.

3. In apparatus as defined in claim 1, including:
- a plurality of separate heat exchange means for heating or cooling makeup air for different areas;
- means for circulating said heated heat transfer liquid through any of said heat exchange means; and
- means for alternatively circulating said chilled water through any of said heat exchange means.

4. In apparatus as defined in claim 1, wherein said chiller includes:
- a partition disposed centrally of a chamber for said water bath and depending from an upper transverse plate to a point spaced above the bottom of said chamber.

5. In apparatus as defined in claim 1, wherein:
- said heat transfer liquid is water and said heat exchanger is below said chiller;
- a supply pipe connects said heat exchanger with a pump;
- a return pipe is connected to said heat exchanger;
- a lower portion of said water bath of said chiller is connected with said supply pipe;
- a chiller return pipe is positioned to return water to said chiller;
- first pipe means connects said pump with an inlet of said heat exchange means;
- second pipe means leads from an outlet of said heat exchange means; and
- valve means is connected to said second pipe means for alternatively connecting said second pipe means with said heat exchanger return pipe or said chiller return pipe, whereby said chiller supplies water to reduce air entrapment when a changeover in supply to said heat exchange means from said heat exchanger to said chiller, or vice versa, takes place.

6. In apparatus as defined in claim 1, wherein said chiller comprises:
- longitudinally elongated, upright opposed walls at the edges of an inlet opening in a bottom, and side, bottom and end walls forming, with said opposed walls, a pair of water bath spaces;
- a longitudinally elongated, first transverse baffle overlying said opposed walls and baffles depending from the edges of said first transverse baffle, to force air moving through said inlet to move over and around the tops of each of said opposed walls;
- said depending baffles each having a lower flange inclined toward the corresponding opposed wall for directing said air into engagement with the corresponding water bath;
- second transverse baffles extending inwardly from said side walls to a point above the respective first transverse baffles; and
- a depending flange along the inner edge of each of said second transverse baffles.

7. In apparatus as defined in claim 6, wherein said chiller includes:
- a central lower partition dividing said inlet into two inlet passages and extending between said upright walls and upwardly to said first transverse baffle;
- a central upper partition dividing the space above said first transverse baffles and extending between and above said second transverse baffles; and
- separate outlets for the spaces above said second transverse baffles.

8. In apparatus as defined in claim 1, wherein said chiller comprises:
- a longitudinally elongated bottom and opposed, upwardly extending walls within which a water chamber for a water bath is contained, said walls and spaced longitudinal plates above said walls causing air to flow over each said wall and into the water chamber; and a baffle extending downwardly from the inner edge of each plate.

9. In apparatus as defined in claim 8, including:

means including spray nozzles for directing water toward said bath from a position above said bath for engagement by said gas after passage toward or against said water bath.

10. In apparatus as defined in claim 8, wherein:

said opposed walls are upright;

said longitudinal plates are horizontal; and said baffles extend outwardly toward said walls.

11. In apparatus as defined in claim 8, wherein:

said opposed walls are inclined outwardly;

said longitudinal plates are inclined downwardly and inwardly; and said baffles are inclined downwardly and inwardly.

12. In apparatus as defined in claim 8, including:

a longitudinally elongated, central, upper transverse plate, above said first-mentioned plates, and a depending flange at each of the opposite sides thereof; and a series of nozzles on the underside of said upper transverse plate spaced longitudinally and each producing a laterally and longitudinally directed, horizontal spray at least a portion of which impinges against each depending flange of said upper transverse plate.

13. In apparatus as defined in claim 1, wherein:

said source of waste energy, including heat, comprises a grease extraction ventilator mounted to receive fumes and heated air from cooking equipment; and including means for causing movement of air from the area of said cooking equipment and through the grease extraction ventilator.

14. In apparatus as defined in claim 13, wherein:

said grease extraction ventilator is provided with water contact means for removing grease, smoke and fumes from heated air from said cooking equipment.

15. In apparatus as defined in claim 13, wherein:

said heat transfer liquid circulated through said heat exchanger is water; and means for recirculating said heat transfer water of said heat exchanger to and from said water contact means of said grease extraction ventilator when said chilled water from said chiller is circulated through said heat exchange means.

16. In apparatus as defined in claim 14, wherein said water contact means includes:

a water chamber having an outwardly inclined front wall, an upright rear wall and upright end walls;

an inwardly and downwardly disposed flange spaced above said front wall and extending rearwardly from a position generally above the upper end of said front wall, said flange diverging from said front wall;

a plate mounted on said flange and essentially coplanar therewith, said plate being adjustable upwardly and downwardly along said flange; and a lip extending downwardly and forwardly from the lower edge of said plate.

17. In apparatus as defined in claim 16, including:

an angular baffle extending forwardly from said rear wall and diverging from said plate and flange;

a horizontal baffle extending forwardly from the upper edge of said angular baffle;

a lip depending forwardly from the forward end of said horizontal baffle; and means enclosing a space into which said horizontal baffle extends and including a lower wall from the rear edge of which said flange extends downwardly and rearwardly.

* * * * *